US010020611B2

(12) United States Patent
Miwa et al.

(10) Patent No.: US 10,020,611 B2
(45) Date of Patent: Jul. 10, 2018

(54) CONNECTOR HAVING A HOUSING WITH A DRAINAGE HOLE LEADING TO AN OUTSIDE OF THE CONNECTOR

(71) Applicant: YAZAKI CORPORATION, Tokyo (JP)

(72) Inventors: Takeya Miwa, Shizuoka (JP); Kiyotaka Mizuno, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/851,988

(22) Filed: Dec. 22, 2017

(65) Prior Publication Data

US 2018/0123284 A1 May 3, 2018

Related U.S. Application Data

(63) Continuation of application No. PCT/JP2016/071643, filed on Jul. 22, 2016.

(30) Foreign Application Priority Data

Jul. 22, 2015 (JP) ..... 2015-144514

(51) Int. Cl.
*H01R 4/64* (2006.01)
*H01R 13/52* (2006.01)
(Continued)

(52) U.S. Cl.
CPC ..... *H01R 13/5227* (2013.01); *H01R 13/422* (2013.01); *H01R 13/631* (2013.01)

(58) Field of Classification Search
CPC ..... H01R 13/5227; H01R 2201/26
(Continued)

(56) References Cited

U.S. PATENT DOCUMENTS 4,793,819 A * 12/1988 Berg ..... H01R 13/5227 174/67
5,816,643 A * 10/1998 Itou ..... B60L 11/1818 296/97.22
(Continued)

FOREIGN PATENT DOCUMENTS

JP 2008-243569 A 10/2008
JP 2011-220191 A 11/2011
(Continued)

OTHER PUBLICATIONS

International Preliminary Report on Patentability and English language Written Opinion of the International Search Report for PCT/JP2016/071643 dated Jan. 23, 2018.
(Continued)

*Primary Examiner* — Chandrika Prasad
(74) *Attorney, Agent, or Firm* — Kenealy Vaidya LLP

(57) ABSTRACT

In a connector which accommodates female terminals in a plurality of female terminal accommodating chambers arranged side by side in a connector housing, each of the plurality of female terminal accommodating chambers in the connector housing has a protruding enclosure wall provided in such a way that walls enclosing the outer periphery of each female terminal protrude towards a direction of connector engagement with a connection mating connector accommodating male terminals which connect to each of the female terminals. Further, an inter-terminal through hole which penetrates through the inside of the connector housing and connects to the outside of the connector housing is formed in a wall coupling base ends of the protruding enclosure walls of at least one group of adjacent female terminal accommodating chambers.

4 Claims, 12 Drawing Sheets

(51) Int. Cl.
*H01R 13/631* (2006.01)
*H01R 13/422* (2006.01)

(58) Field of Classification Search
USPC ..... 439/34, 205, 206
See application file for complete search history.

(56) References Cited

U.S. PATENT DOCUMENTS

| | | | | |
|---|---|---|---|---|
| 8,597,039 | B2 * | 12/2013 | Osawa | H01R 13/5227 439/205 |
| 8,662,910 | B2 * | 3/2014 | Ichio | H01R 13/5208 439/206 |
| 9,478,899 | B2 * | 10/2016 | Kurita | H01R 13/5227 |
| 2012/0258617 | A1 * | 10/2012 | Osawa | H01R 13/5227 439/205 |
| 2012/0295460 | A1 * | 11/2012 | Ichio | H01R 13/5208 439/205 |
| 2015/0334854 | A1 | 11/2015 | Ushio | |

FOREIGN PATENT DOCUMENTS

| | | | |
|---|---|---|---|
| JP | 2013-178942 | A | 9/2013 |
| JP | 2014-159235 | A | 9/2014 |
| WO | 2015/004053 | A1 | 1/2015 |

OTHER PUBLICATIONS

International Search Report and Written Opinion of the International Search Report for PCT/JP2016/071643 dated Oct. 4, 2016.

* cited by examiner

CONNECTOR HAVING A HOUSING WITH A DRAINAGE HOLE LEADING TO AN OUTSIDE OF THE CONNECTOR

CROSS REFERENCE TO RELATED APPLICATIONS

This application is a continuation of PCT application No. PCT/JP16/071643, which was filed on Jul. 22, 2016 based on Japanese Patent Application (No. 2015-144514) filed on Jul. 22, 2015, the contents of which are incorporated herein by reference.

BACKGROUND OF THE INVENTION

1. Field of the Invention

The present invention relates to a connector which accommodates female terminals in a plurality of female terminal accommodating chambers arranged side by side in a connector housing, and a connector engagement structure of the connector and a connection mating connector.

2. Description of the Related Art

Conventionally, a connector that is arranged in fuel and used as a power supply connector of a fuel pump or the like is liquid-tight so that the fuel does not invade into a connector housing. However, since it is difficult to completely suppress the invasion of the fuel into the connector housing, a configuration in which a leakage current hardly occurs even when the fuel invaded into the connector housing is applied.

Patent Document 1 describes an electrical connector for a fuel tank in which a base support portion is provided at a base of a terminal (male terminal), and a support inclined portion for causing water droplets to flow downward is provided at a coupling portion with the terminal (male terminal) at an upper end of the base support portion.

In addition, Patent Document 2 describes a connector engagement structure in which a block is provided in such a way that walls enclosing the outer periphery of each female terminal protrude towards a direction of connector engagement with a connection mating connector which accommodates male terminals, to be connected to each of the female terminals, in each of a plurality of terminal accommodating chambers, and a partition wall of the connection mating connector is fitted between the blocks so as to make a gap therebetween as small as possible, so that fuel hardly invades into the vicinity of the male and female terminals.

Patent Document 1: JP 2008-243569 A

Patent Document 2: JP 2011-220191 A

SUMMARY OF THE INVENTION

However, in the connectors described in Patent Documents 1 and 2, when fuel invaded in a state of connector engagement with the connection mating connector, the fuel invaded between the terminals tends to remain and may cause a leakage current, therefore, it cannot be said that the leakage current is reliably prevented.

The present invention has been made in view of the above problems, and an object of the present invention is to provide a connector and a connector engagement structure which can reliably prevent the occurrence of a leakage current even when a material causing a leakage current invaded between the terminals.

To solve the above problems and achieve the object, the connector and the connector engagement structure according to the present invention are characterized in the following configurations (1) to (5).

(1) A connector which accommodates female terminals in a plurality of female terminal accommodating chambers arranged side by side in a connector housing, wherein the connector housing has:

a protruding enclosure wall provided at each of the female terminal accommodating chambers in such a way that walls enclosing an outer periphery of each female terminal protrude towards a direction of connector engagement with a connection mating connector; and a coupling wall configured to couple base ends of the protruding enclosure walls of at least one group of the female terminal accommodating chambers adjacent to each other, and wherein an inter-terminal through hole which penetrates through an inside of the connector housing and is communicated to an outside of the connector housing is formed in the coupling wall.

(2) The connector according to (1), wherein the inter-terminal through hole is formed along a direction in which a material causing a leakage current invaded into the hole is discharged to the outside of the connector housing due to the own weight thereof.

(3) A connector engagement structure of the connector according to (1) or (2) and the connection mating connector which connects male terminals in a male terminal side connector housing with the female terminals of the connector by the connector engagement with the connector, wherein the male terminal side connector housing of the connection mating connector includes:

a male terminal holding wall configured to hold the male terminals so as to protrude towards a direction of connector engagement; and a partition wall erected on the male terminal holding wall and partitioning the adjacent male terminals, and wherein, in a state of connector engagement with the connector, the partition wall is formed to be fitted between the protruding enclosure walls of the adjacent female terminal accommodating chambers and to be fitted to the base ends of the protruding enclosure walls.

(4) The connector engagement structure according to (3), including:

a hood-shaped wall erected on the male terminal holding wall in a hood shape and forming a fitting opening for fitting the connector housing at an end portion thereof; and a pair of guide ribs respectively extending from the fitting opening along the direction of connector engagement inwardly on opposite inner wall surfaces of the hood-shaped wall, wherein extending ends of the pair of guide ribs are coupled to both ends of the partition wall formed so as to extend to both ends of the male terminal holding wall, and wherein the connector housing is formed with a pair of guide grooves extending, on outer wall surfaces opposed to the opposite inner wall surfaces respectively, along the direction of connector engagement so as to engage with the pair of guide ribs.

(5) The connector engagement structure according to (3) or (4), wherein, in a state of connector engagement of the connector and the connection mating connector, the outer wall surface of the connector housing has a protruding part located at the vicinity of an end face of the male terminal side connector housing at a fitting opening side, and wherein at least one of the protruding part and a part of the male terminal side connector housing around the protruding part is formed with a leading surface which leads the material causing a leakage current in a direction in which the material is discharged due to the own weight thereof.

DETAILED DESCRIPTION OF THE EXEMPLARY EMBODIMENTS

Hereinafter, preferred embodiments of a connector and a connector engagement structure according to the present invention will be described in detail with reference to the drawings.

Embodiment

Figure 1A:
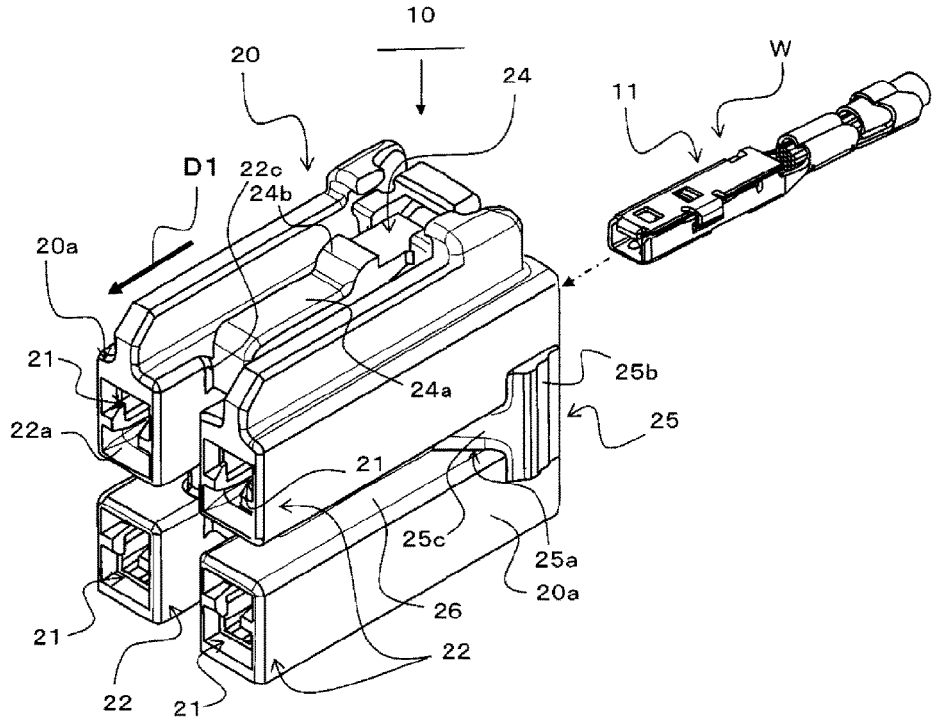
FIG. 1A is a perspective view showing a state before a female terminal of a connector according to an embodiment of the present invention is inserted into a connector housing.
Figure 1B:
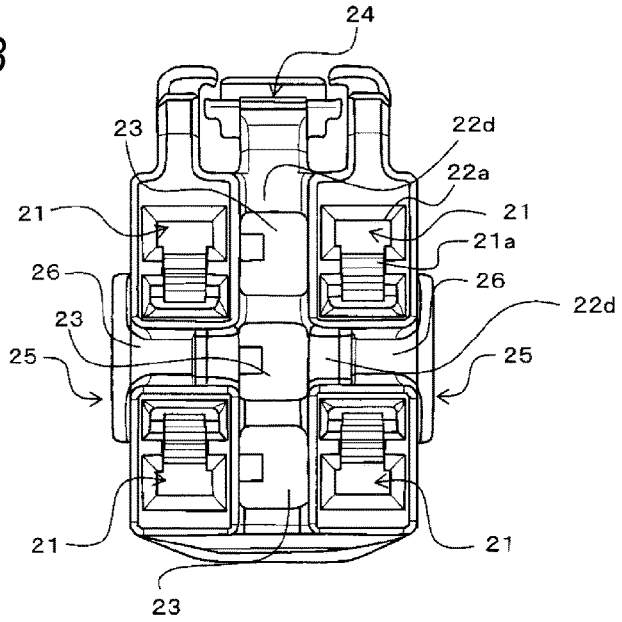
FIG. 1B is a front view of the connector housing shown in FIG. 1A.
Figure 2:
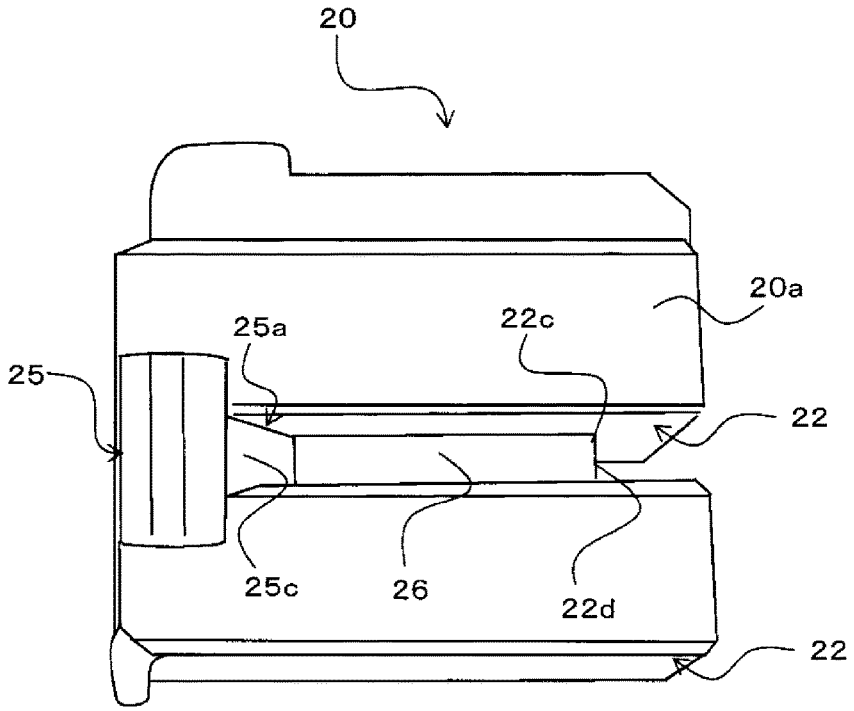
FIG. 2 is a view of the connector housing shown in FIGS. 1A and 1B as viewed from an oblique side.
Figure 3A:
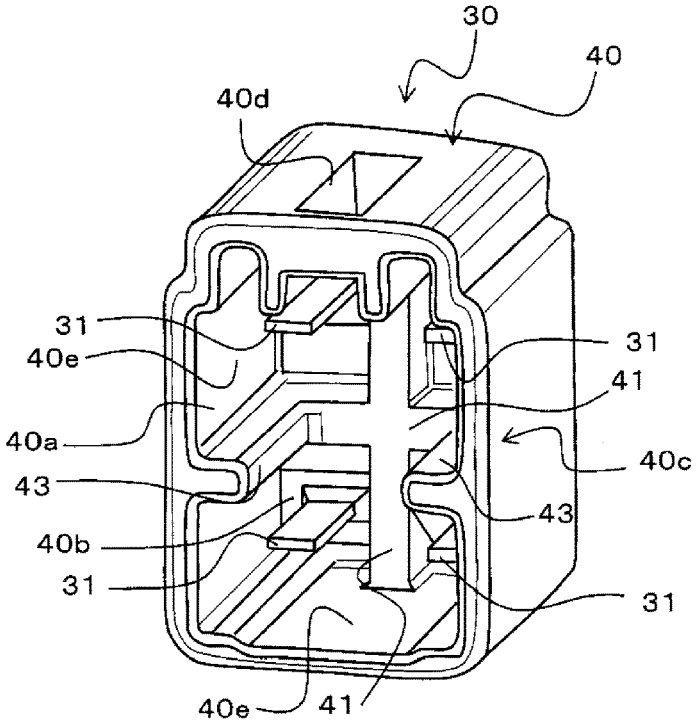
FIG. 3A is a perspective view of a connection mating connector used in a connector engagement structure according to an embodiment of the present invention.
Figure 3B:
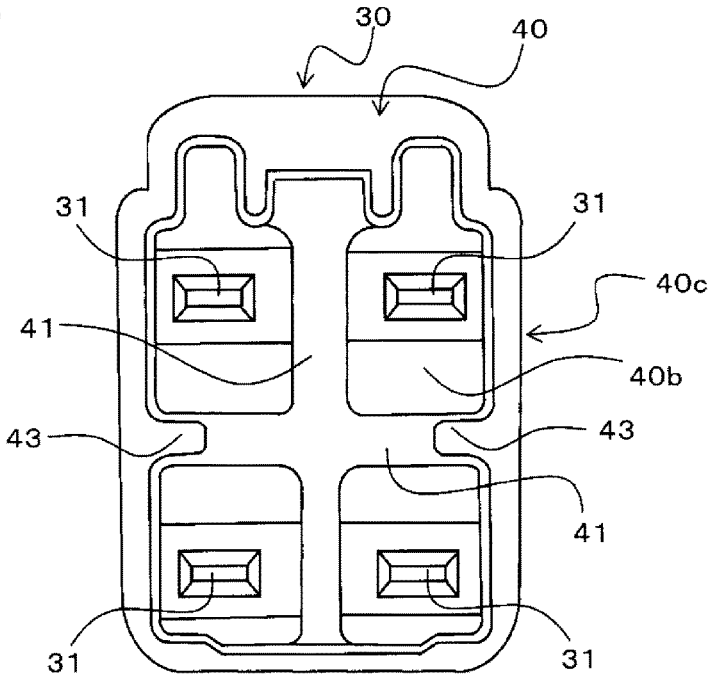
FIG. 3B is a front view of the connection mating connector shown in FIG. 3A.
Figure 4:
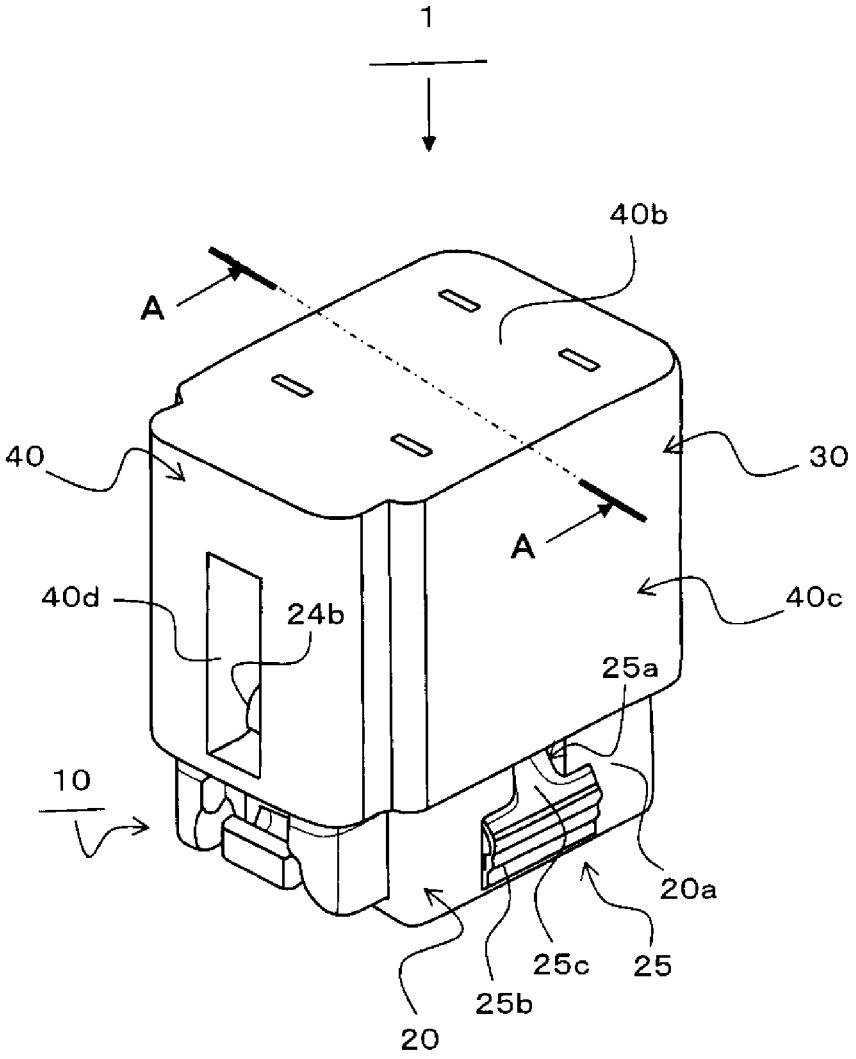
FIG. 4 is a perspective view of the connector and the connection mating connector which are connector engaged.
Figure 5:
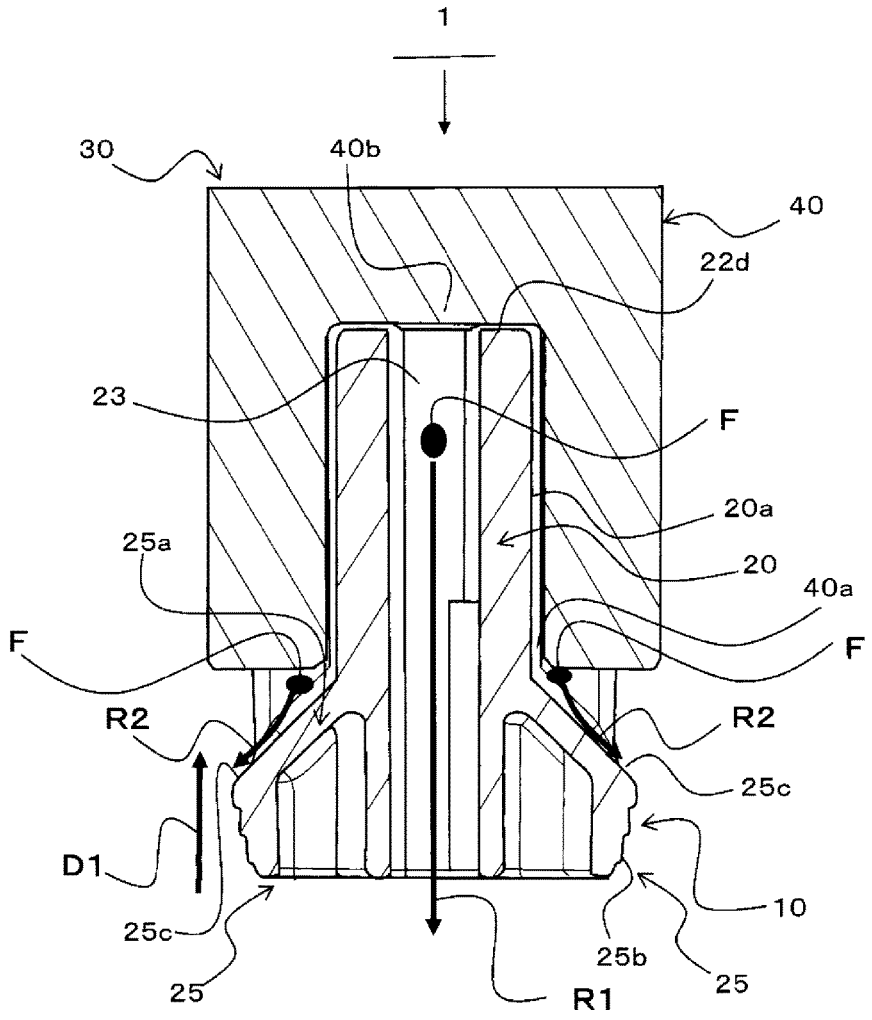
FIG. 5 is a sectional view taken along a line A-A of the connector engaged connector and connection mating connector shown in FIG. 4.
Figure 6:
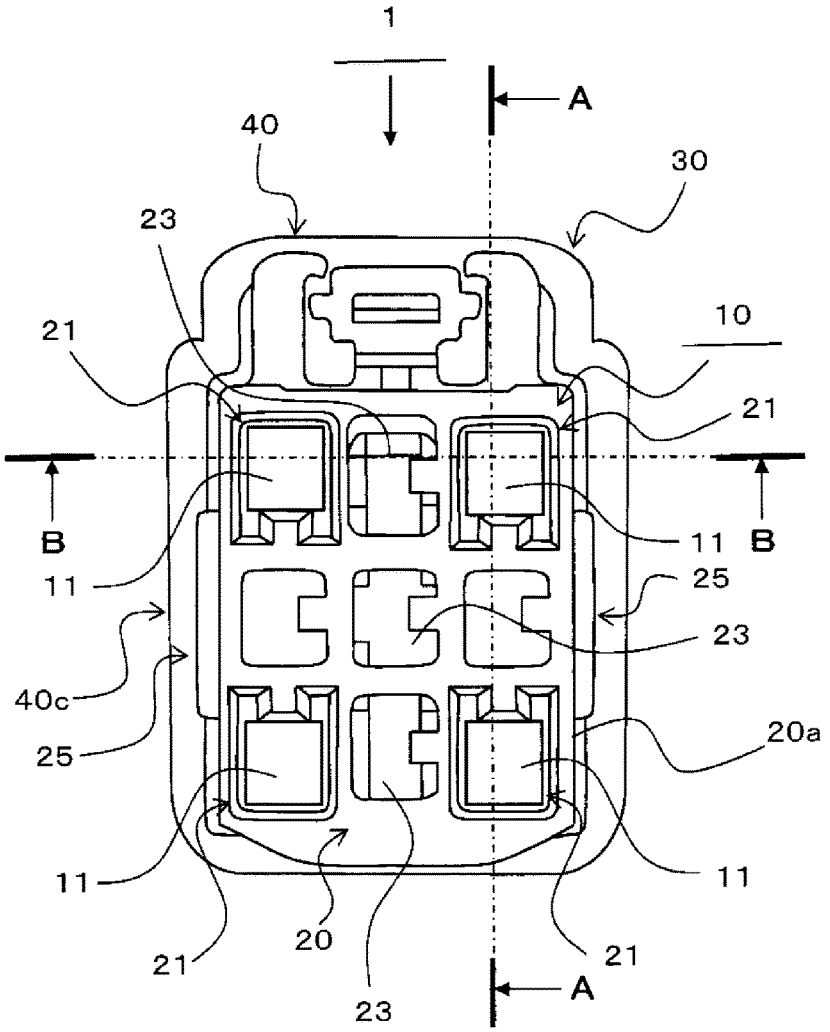
FIG. 6 is a view of the connector as viewed from a terminal insertion opening side.
Figure 7A:
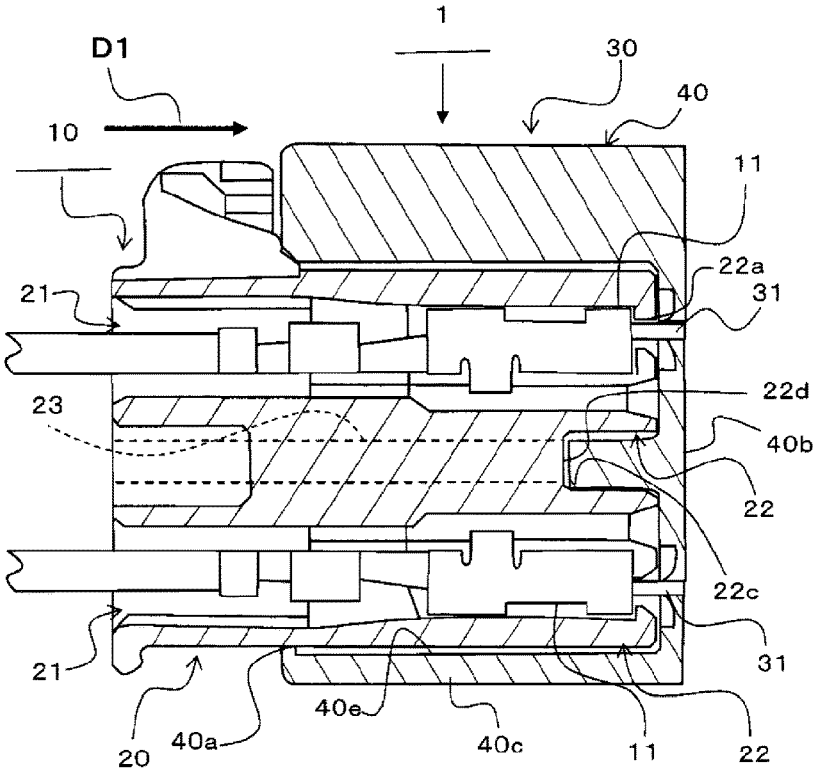
FIG. 7A is a sectional view taken along the line A-A of the connector shown in FIG. 6.
Figure 7B:
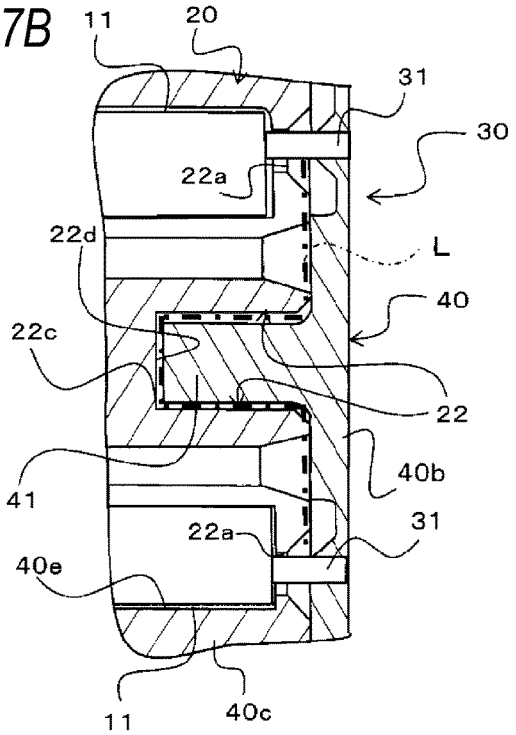
FIG. 7B is an enlarged view of the vicinity of an opening on a side where the female terminal of a female terminal accommodating chamber of the connector shown in FIG. 7A is connected with a male terminal.
Figure 8A:
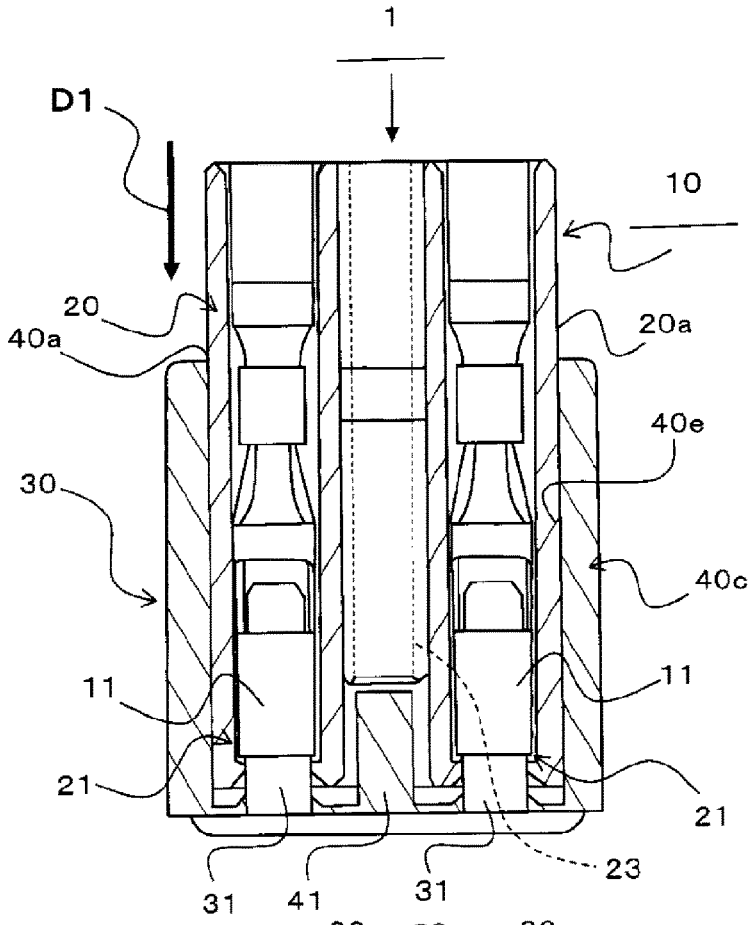
FIG. 8A is a sectional view taken along a line B-B of the connector shown in FIG. 6.
Figure 8B:
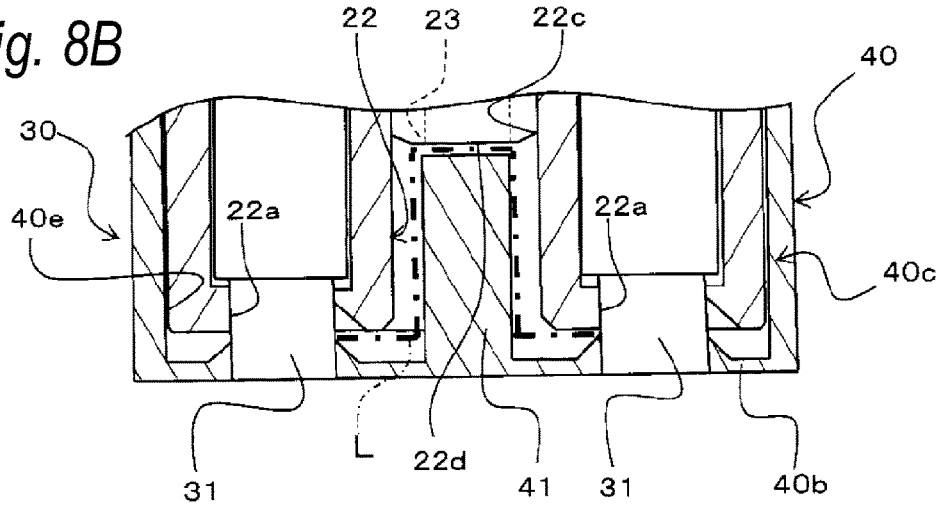
FIG. 8B is an enlarged view of the vicinity of the opening on a side where the female terminal of the female terminal accommodating chamber of the connector shown in FIG. 8A is connected with the male terminal.
Figure 9:
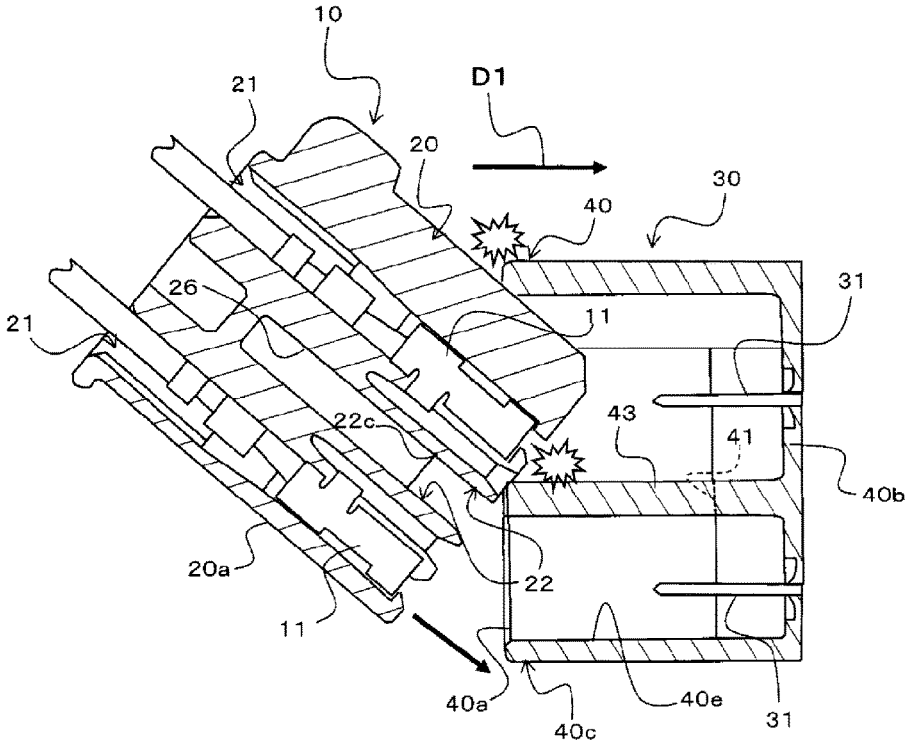
FIG. 9 is a view showing a state when the connector and the connection mating connector are connector engaged in an engagement direction other than a regular engagement direction.

FIG. 1A is a perspective view showing a state before female terminals 11 of a connector 10 according to an embodiment of the present invention are inserted into a connector housing 20, and FIG. 1B is a front view of the connector housing 20 shown in FIG. 1A. FIG. 2 is a view of the connector housing 20 shown in FIG. 1A and FIG. 1B as viewed from an oblique side. FIG. 3A is a perspective view of a connection mating connector 30 used in a connector engagement structure 1 according to an embodiment of the present invention, and FIG. 3B is a front view of the connection mating connector 30 shown in FIG. 3A. FIG. 4 is a perspective view of the connector 10 and the connection mating connector 30 which are connector engaged. FIG. 5 is a sectional view taken along a line A-A of the connector engaged connector 10 and connection mating connector 30 shown in FIG. 4. FIG. 6 is a view of the connector 10 as viewed from a terminal insertion opening side. FIG. 7A is a sectional view taken along the line A-A of the connector 10 shown in FIG. 6, and FIG. 7B is an enlarged view of the vicinity of openings 22*a* on a side where female terminals 11 of female terminal accommodating chambers 21 of the connector 10 shown in FIG. 7A is connected with male terminals 31. FIG. 8A is a sectional view taken along the line B-B of the connector 10 shown in FIG. 6, and FIG. 8B is an enlarged view of the vicinity of the openings 22*a* on a side where female terminals 11 of female terminal accommodating chambers 21 of the connector 10 shown in FIG. 8A is connected with male terminals 31. FIG. 9 is a view showing a state when the connector 10 and the connection mating connector 30 are connector engaged in an engagement direction other than a regular engagement direction.

The connector engagement structure 1 according to an embodiment of the present invention is used, for example, as a power connection connector of a fuel pump (not shown) and is used in a state of being immersed in fuel F in a fuel tank (not shown).

First, the connector 10 will be described.

As shown in FIG. 1A, the connector 10 accommodates the female terminals 11 of terminal-equipped wires W in each of female terminal accommodating chambers 21 of the connector housing 20.

The connector housing 20 is made of insulating synthetic resin, and formed into a substantially rectangular parallelepiped shape as a whole.

The connector housing 20 has four female terminal accommodating chambers 21, and each of the female terminal accommodating chambers 21 has a protruding enclosure wall 22 provided in such a way that walls enclosing the outer periphery of each female terminal 11 protrude towards a direction of connector engagement D1 with a connection mating connector 30 accommodating the male terminals 31 which respectively connect to the female terminals 11. In addition, the connector housing 20 has a wall 22*d* which couples base ends 22*c* of the protruding enclosure walls 22 of at least one group of adjacent female terminal accommodating chambers 21, and an inter-terminal through hole 23 which penetrates through the inside of the connector housing 20 and connects to the outside of the connector housing 20 is formed in the wall 22*d*.

Further, the connector housing 20 has an elastic engagement arm 24 which engages with a male terminal side connector housing 40 described later of the connection mating connector 30 at a connector engagement position, and pressing operation portions 25 which are operation portions used by an operator to press the connector housing 20 in the direction of connector engagement.

As shown in FIG. 1B, the four female terminal accommodating chambers 21 are arranged side by side in vertical and horizontal directions. Each of the female terminal accommodating chambers 21 is configured to lock each female terminal 11 at a predetermined position by an elastic locking arm 21*a* provided inside of each female terminal accommodating chamber 21.

Each protruding enclosure wall 22 is a wall configured to form a front end portion of each female terminal accommodating chamber 21 in the engagement direction, and is formed into a substantially rectangular tube shape so as to enclose the outer periphery of each female terminal 11.

Each protruding enclosure wall 22 is not limited to the substantially rectangular tube shape, and may have other shapes as long as each protruding enclosure wall 22 can enclose the outer periphery of each female terminal 11. For example, when each female terminal 11 has a circular cross section, each protruding enclosure wall 22 may have a substantially cylindrical shape.

The protruding enclosure walls 22 are configured such that the male terminals 31 of the connection mating connector 30 are inserted from the openings 22*a* of a front end face in the engagement direction.

The inter-terminal through holes 23 are formed at three positions of the connector housing 20.

Two inter-terminal through holes 23 among the three inter-terminal through holes 23 are formed between the female terminal accommodating chambers 21 arranged side by side in a horizontal direction in FIG. 1. In addition, the one remaining inter-terminal through hole 23 is formed substantially at a center of the connector housing 20.

The inter-terminal through holes 23 are formed along a direction in which fuel F which is the material causing a leakage current invaded into the hole is discharged to the outside of the connector housing 20 due to the own weight thereof.

In the present embodiment, since the direction of connector engagement D1 of the connector 10 is a vertical direction, the inter-terminal through holes 23 are formed so as to penetrate through the connector housing 20 in the vertical direction. By forming the inter-terminal through holes 23 in the connector housing 20, the fuel F invaded between the female terminals 11 is discharged outwardly through the inter-terminal through holes 23 as indicated by an arrow R1 in FIG. 5.

Further, in the present embodiment, even though an example is exemplified in which the inter-terminal through holes 23 are formed at three positions of the connector housing 20, the number of the inter-terminal through holes 23 is not limited to three, and may be one as long as the inter-terminal through holes 23 are formed on the wall 22*d* coupling base ends 22*c* of the protruding enclosure walls 22 of at least one group of adjacent female terminal accommodating chambers 21.

The elastic engagement arm 24 has an elastic arm 24*a* provided on one side surface of the connector housing 20, and an engagement protrusion 24*b* provided on the elastic arm 24*a*.

The elastic engagement arm 24 locks the connector housing 20 and the male terminal side connector housing 40 at the connector engagement position by engaging the engagement protrusion 24*b* with an engagement hole 40*d* of the male terminal side connector housing 40.

In a state of connector engagement of the connector 10 and the connection mating connector 30, the pressing operation portions 25 are provided so as to protrude towards an outer wall surface 20*a* of the connector housing 20 at the vicinity of the end face of the male terminal side connector housing 40 at a fitting opening 40*a* side.

Each pressing operation portion 25 is formed with, on the protruding part, a leading surface 25*c* which leads the fuel F in a direction in which the fuel F is discharged due to the own weight thereof.

More specifically, each of the pressing operation portions 25 has a coupling portion 25*a* which is a part coupled to the outer wall surface 20*a* of the connector housing 20 and an operation portion 25*b* which is a part to be pressed by an operator, and the leading surface 25*c* is formed on the coupling portion 25*a*.

By forming such leading surfaces 25*c* on the connector housing 20, even in a case where the connector engaged connector 10 and connection mating connector 30 are partially exposed from a liquid surface of the fuel F due to the decrease of the fuel F in the fuel tank (not shown), the fuel F does not remain attached to the pressing operation portions 25 protruding on the outer wall surface 20*a* of the connector housing 20, but is led to the fuel tank by the leading surfaces 25*c* as indicated by arrows R2 in FIG. 5.

In addition, the connector housing 20 is formed with a pair of guide grooves 26, 26 extending, on the outer wall surfaces 20*a* opposed to opposite inner wall surfaces 40*e*, 40*e* of a later-described hood-shaped wall 40*c* respectively, along the direction of connector engagement so as to engage with a pair of guide ribs 43, 43.

In the present embodiment, an outer shape of the wall 22*d*, configured to be continuous such that the female terminal accommodating chambers 21 are formed from the base ends 22*c* of the protruding enclosure walls 22 along the direction of connector engagement, is aligned with an outer shape of each protruding enclosure wall 22 formed into substantially rectangular tube shape, so that each guide groove 26 is formed between each of female terminal accommodating chambers 21 along the direction of connector engagement.

In such connector 10, since each opening 22*a* at a side where each female terminal 11 of each of the female terminal accommodating chambers 21 is connected with each of the male terminals 31 is formed by each of the protruding enclosure walls 22 enclosing the outer periphery of each female terminal 11, a protruding wall surface of each of the protruding enclosure walls 22 is configured such that a creepage distance between the adjacent female terminals 11 is longer.

In addition, since the inter-terminal through holes 23 are formed in the wall 22*d* coupling the base ends 22*c* of the protruding enclosure walls 22 of the adjacent female terminal accommodating chambers 21, an area of the wall coupling the adjacent female terminal accommodating chambers 21 is reduced and the fuel F is discharged to the outside of the connector housing 20 through the inter-terminal through holes 23. Accordingly, the fuel F invaded between the female terminals 11 hardly remains.

Next, the connection mating connector 30 will be described.

The connection mating connector 30 has four male terminals 31 connected to the four female terminals 11 of the connector 10 respectively, and the male terminal side connector housing 40 to be engaged with the connector housing 20.

The male terminal side connector housing 40 is made of insulating synthetic resin, and formed into a substantially rectangular parallelepiped box shape with one surface serving as the fitting opening 40*a* of the connector 10.

The male terminal side connector housing 40 has a male terminal holding wall 40*b* for holding the male terminals 31 to protrude towards the direction of connector engagement. In addition, the partition wall 41 configured to partition the adjacent male terminals 31 is erected on the male terminal holding wall 40*b* so as to be fitted between the protruding enclosure walls 22 of the adjacent female terminal accommodating chambers 21 and to be fitted to the base ends 22*c* of the protruding enclosure walls 22 in a state of connector engagement with the connector 10.

More specifically, the male terminal side connector housing 40 has a hood-shaped wall 40*c* which is erected on the male terminal holding wall 40*b* in a hood shape. The hood-shaped wall 40*c* forms the fitting opening 40*a* configured to fit the connector housing 20 at an end portion thereof.

The male terminal holding wall 40*b* is configured to hold each male terminal 31 at a position corresponding to each of the female terminals 11 accommodated in the four female terminal accommodating chambers 21 of the connector housing 20.

Therefore, as shown in FIG. 3B, the four male terminals 31 are arranged side by side in vertical and horizontal directions, and held on the male terminal holding wall 40*b*.

The partition wall 41 is erected on the male terminal holding wall 40*b* in a way of crossing a cross passing through substantially the center of the male terminal holding wall 40*b*.

In addition, the male terminal side connector housing 40 has the pair of guide ribs 43, 43 on the inner wall surfaces 40*e*, 40*e* opposite to the hood-shaped wall 40*c*. The pair of guide ribs 43, 43 is formed such that extending ends extending inwardly from the fitting opening 40*a* along the direction of connector engagement are coupled to both ends of the partition wall 41 formed so as to extend to both ends of the male terminal holding wall 40*b*.

In FIG. 3, each guide rib 43 is respectively coupled to the end portions of the partition wall 41 which is erected from one end to the other end of the male terminal holding wall 40*b* in the horizontal direction in a way of passing through substantially the center of the male terminal holding wall 40*b*.

In addition, the male terminal side connector housing 40 is continuously provided with the guide ribs 43 and the partition wall 41 on the inner wall surfaces 40*e* along a horseshoe-shaped cross-sectional outline, so that the strength of the hood-shaped wall 40*c* is increased.

In such connector engagement structure 1 of the connector 10 and the connection mating connector 30, the openings 22*a* are formed, on the connector housing 20 at the side where the female terminals 11 of the adjacent female terminal accommodating chambers 21 are connected with the male terminals 31, by the protruding enclosure walls 22 enclosing the outer peripheries of the female terminals. Moreover, the partition wall 41 for partitioning the adjacent male terminals 31 is provided in the male terminal side connector housing 40 so as to be fitted between the protruding enclosure walls 22 of the adjacent female terminal accommodating chambers 21 and to be fitted to the base ends 22*c* of the protruding enclosure walls 22. Therefore, as shown by a line L in FIGS. 7B and 8B, the protruding wall surfaces of the protruding enclosure walls 22 and the wall surface of the partition wall 41 are configured such that the creepage distance between the adjacent male and female terminals is longer.

In addition, when the connector 10 and the connection mating connector 30 are connector engaged, the connector housing 20 and the male terminal side connector housing 40 can be engaged while maintaining the regular posture by the guide function in the direction of connector engagement due to the engagement of the guide grooves 26 and the guide ribs 43.

As shown in FIG. 9, in the connector engagement structure 1, when the connector engagement is performed in an engagement direction other than the regular engagement direction, that is, when a so-called prying engagement is performed, the guide ribs 43 formed up to the end faces of the fitting opening 40*a* of the male terminal side connector housing 40 prevents the invasion of the connector housing 20. Accordingly, the connector housing 20 can be prevented from coming into contact with the male terminals 31.

In the connector 10 according to the embodiment of the present invention, since the protruding enclosure walls 22 are formed to enclose the outer peripheries of the female terminals 11, the protruding wall surface of each of the protruding enclosure wall 22 is configured such that the creepage distance between the adjacent female terminals 11 is longer. Moreover, since the inter-terminal through holes 23 are formed in the wall 22*d* coupling the female terminal accommodating chambers 21, the area of the wall 22*d* coupling the adjacent female terminal accommodating chambers 21 is reduced and the fuel F causing a leakage current is discharged to the outside of the connector housing 20 through the inter-terminal through holes 23. Therefore, the material causing a leakage current invaded into the female terminals 11 hardly remains and the occurrence of a leakage current can be reliably prevented even when the material causing a leakage current invaded between the terminals.

In the connector 10 according to the embodiment of the present invention, since the inter-terminal through holes 23 are formed along the direction in which the fuel F invaded into the hole is discharged to the outside of the connector housing 20 due to the own weight, the material causing a leakage current invaded between the female terminals 11 can be easily discharged to the outside of the connector housing 20 due to the own weight thereof.

In the connector 10 according to the embodiment of the present invention, since the inter-terminal through holes 23 are configured to penetrate through the connector housing 20 in the vertical direction, the fuel F can be reliably discharged from the inter-terminal through holes 23 due to the own weight thereof.

In addition, in the connector engagement structure 1 according to the embodiment of the present invention, the openings 22*a* are formed, on the connector housing 20 at the side where the female terminals 11 of the adjacent female terminal accommodating chambers 21 are connected with the male terminals 31, by the protruding enclosure walls 22 enclosing the outer peripheries of the female terminals 11, and the partition wall 41 for partitioning the adjacent male terminals 31 is provided in the male terminal side connector housing 40 so as to be fitted between the protruding enclosure walls 22 of the adjacent female terminal accommodating chambers 21 and to be fitted to the base ends 22*c* of the protruding enclosure walls 22. Thereby, the protruding wall surfaces of the protruding enclosure walls 22 and the wall surface of the partition wall 41 are configured such that the creepage distance between the adjacent male and female terminals is longer. Moreover, since the inter-terminal through holes 23 are formed in the wall 22*d* coupling the female terminal accommodating chambers 21, the area of the wall 22*d* coupling the adjacent female terminal accommodating chambers 21 is reduced and the fuel F causing a leakage current is discharged to the outside of the connector housing 20 through the inter-terminal through holes 23, and therefore, the fuel F invaded between the male and female terminals hardly remains. Therefore, the occurrence of a leakage current can be reliably prevented even when the material causing a leakage current invaded between the terminals.

In addition, in the connector engagement structure 1 according to the embodiment of the present invention, the connector housing 20 and the male terminal side connector housing 40 can be engaged in the regular posture by the guide function due to the engagement of the pair of guide grooves 26, 26 and the pair of guide ribs 43, 43. Moreover, since the pair of guide ribs 43, 43 and the partition wall 41 are continuously provided from one end side to the other end side of the cross-sectional outline of the male terminal side connector housing 40, the strength of the entire male terminal side connector housing 40 including the hood-shaped wall 40*c* can be increased.

In addition, in the connector engagement structure 1 according to the embodiment of the present invention, in a state of connector engagement of the connector 10 and the connection mating connector 30, there are the pressing operation portions 25 which are the protruding part on the outer wall surface 20*a* of the connector housing 20 at the vicinity of the end face of the male terminal side connector housing 40 at the fitting opening 40*a* side, and the pressing operation portions 25 are formed with the leading surfaces 25*c* which lead the fuel F in the direction in which the fuel F is discharged due to the own weight thereof. Accordingly, the fuel F can be prevented from remaining attached to the pressing operation portions 25, and waste can be eliminated by returning the fuel F to the fuel tank.

(Modification 1)

Next, the first modification of the connector engagement structure 1 according to the embodiment of the present invention will be described with reference to FIGS. 10 and 11.

Figure 10A:
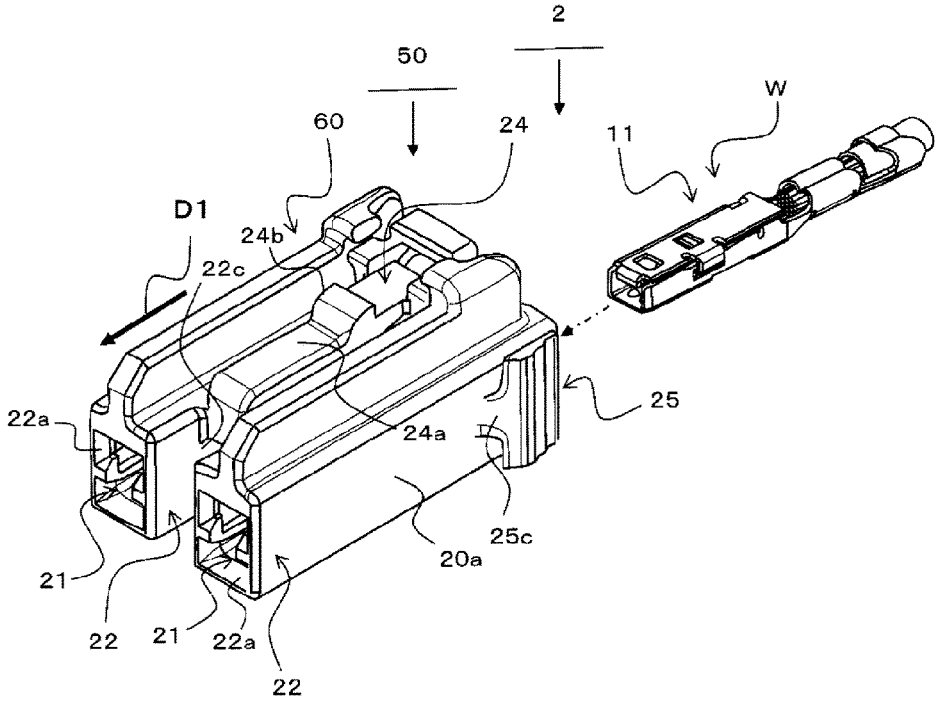
FIG. 10A is a perspective view showing a state before the female terminal of a connector of a first modification is inserted into a connector housing.
Figure 10B:
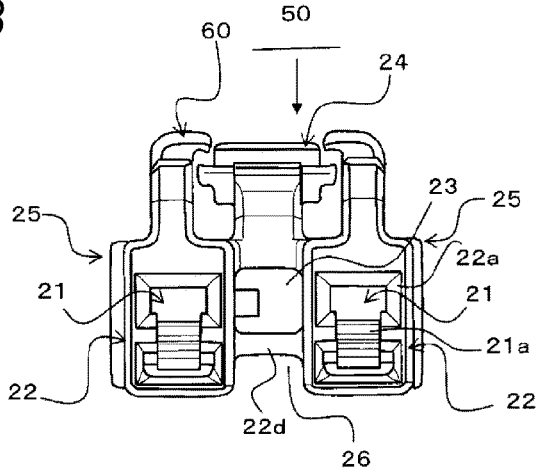
FIG. 10B is a front view of the connector housing shown in FIG. 10A.
Figure 11A:
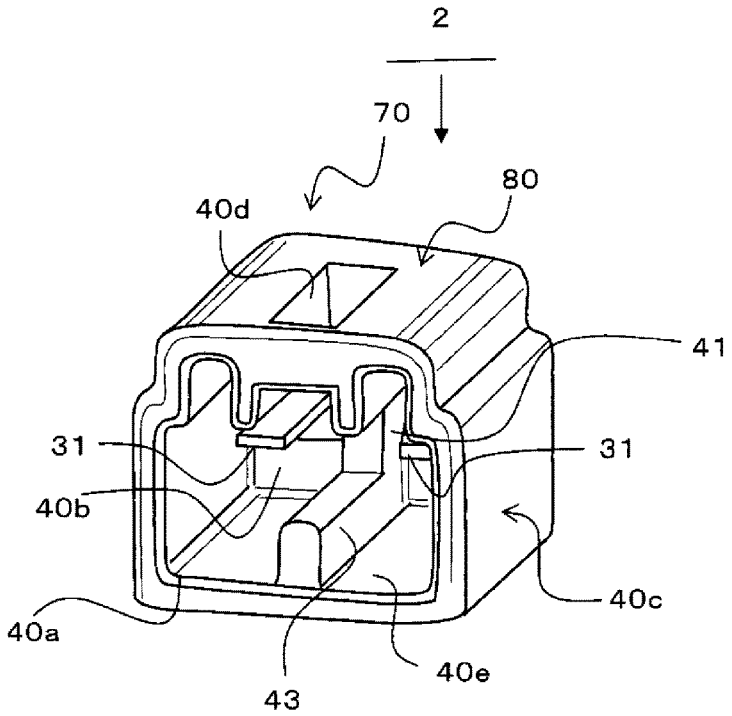
FIG. 11A is a perspective view of a connection mating connector used in a connector engagement structure of the first modification.
Figure 11B:
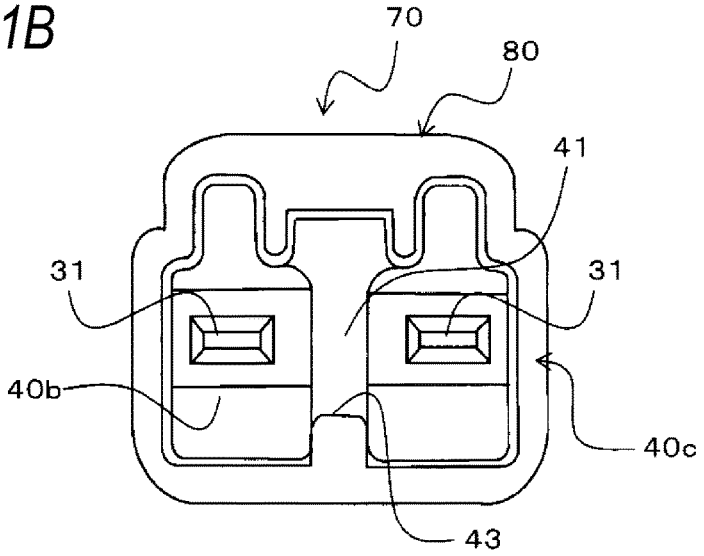
FIG. 11B is a front view of the connection mating connector shown in FIG. 11A.

FIG. 10A is a perspective view showing a state before the female terminal 11 of a connector of the first modification is inserted into a connector housing 60, and FIG. 10B is a front view of the connector housing 60 shown in FIG. 10A. FIG. 11A is a perspective view of a connection mating connector 70 used in a connector engagement structure 2 of the first modification, and FIG. 11B is a front view of the connection mating connector 70 shown in FIG. 11A.

The connector engagement structure 2 of the first modification is different from the connector engagement structure 1 of the embodiment, in which only two female terminal accommodating chambers 21 are provided in the connector housing 60, two female terminals 11 are respectively accommodated in the female terminal accommodating chambers 21, and a male terminal side connector housing 80 corresponds to the connector housing 60 and is configured to hold two male terminals 31.

Other configurations in the first modification are the same as those in the embodiment, and same reference numerals are given to same constituent parts as in the embodiment.

Like the connector engagement structure 1 of the embodiment, in the connector engagement structure 2 of the first modification, openings 22*a* are formed, on the connector housing 60 at a side where female terminals 11 of adjacent female terminal accommodating chambers 21 are connected with male terminals 31, by the protruding enclosure walls 22 enclosing outer peripheries of the female terminals 11, and the partition wall 41 for partitioning adjacent male terminals 31 is provided in the male terminal side connector housing 80 so as to be fitted between the protruding enclosure walls 22 of the adjacent female terminal accommodating chambers 21 and to be fitted to the base ends 22*c* of the protruding enclosure walls 22. Thereby, the protruding wall surfaces of the protruding enclosure walls 22 and a wall surface of the partition wall 41 are configured such that a creepage distance between adjacent male and female terminals is longer, and since the inter-terminal through hole 23 is formed on the wall 22*d* coupling the female terminal accommodating chambers 21, an area of the wall 22*d* coupling the adjacent female terminal accommodating chambers 21 is reduced and the fuel F causing a leakage current is discharged to the outside of the connector housing 60 through the inter-terminal through hole 23. Accordingly, since the fuel F invaded between the male and female terminals hardly remains, the occurrence of a leakage current can be reliably prevented even when a material causing a leakage current invaded between the terminals.

(Modification 2)

Next, the second modification of the connector engagement structure 1 according to the embodiment of the present invention will be described with reference to FIG. 12.

Figure 12:
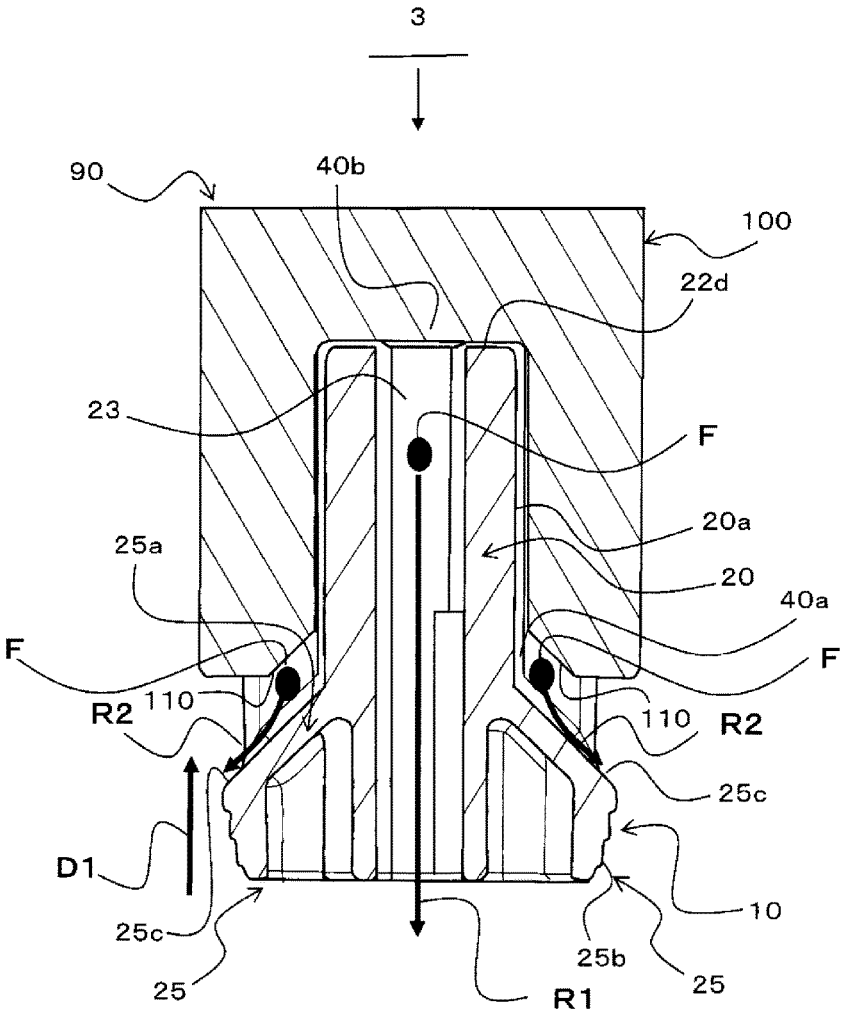
FIG. 12 is a sectional view showing a state of connector engagement of the connector and a connection mating connector.

FIG. 12 is a sectional view showing a state of connector engagement of the connector 10 and a connection mating connector 90.

A connector engagement structure 3 of the second modification is different from the connector engagement structure 1 of the embodiment, in which leading surfaces 110 which lead fuel F in a direction in which the fuel F is discharged due to the own weight thereof are formed in a male terminal side connector housing 100.

Other configurations in the second modification are the same as those in the embodiment, and same reference numerals are given to same constituent parts as in the embodiment.

In the connector engagement structure 3, the leading surfaces 110 for leading the fuel F which is a material causing a leakage current in the direction in which the fuel F is discharged due to the own weight thereof are not only formed on the connector housing 20, but also formed on the male terminal side connector housing 100.

The connector engagement structure 3 of the second modification has the same effect as the connector engagement structure 1 of the embodiment, and since the leading surfaces 25*c*, 110 are respectively formed on the connector housing 20 and the male terminal side connector housing 100, the fuel F does not remain attached to the pressing operation portions 25 protruding on the outer wall surface 20*a* of the connector housing 20, and is easily led to a fuel tank by the leading surfaces 25*c*, 110.

Although the connector engagement structures 1, 2 and 3 according to the embodiment, the first modification and the second modification of the present invention are exemplified for use as power connection connectors of a fuel pump, the structures are not limited thereto, and the same effect can be obtained as long as the structures are used in a connector to be used in an environment in which a material causing a leakage current is likely to invade inter-terminals.

Although the invention made by the present inventor has been concretely described based on the above described embodiments of the invention, the present invention is not limited to the above described embodiments of the invention, and various modifications can be made without departing from the scope thereof.

Here, characteristics of the embodiments of the connector and connector engagement structure according to the present invention described above are summarized briefly in the following [1] to [5] separately.

[1] A connector (10) which accommodates female terminals (11) in a plurality of female terminal accommodating chambers (21) arranged side by side in a connector housing (20), wherein the connector housing has:

a protruding enclosure wall (22) provided at each of the female terminal accommodating chambers in such a way that walls enclosing an outer periphery of each female terminal protrude towards a direction of connector engagement with a connection mating connector; and a coupling wall (22*d*) configured to couple base ends (22*c*) of the protruding enclosure walls of at least one group of the female terminal accommodating chambers adjacent to each other, and wherein an inter-terminal through hole (23) which penetrates through the inside of the connector housing and is communicated to an outside of the connector housing is formed in the coupling wall.

[2] The connector according to [1], wherein the inter-terminal through hole is formed along a direction in which a material (fuel F) causing a leakage current invaded into the hole is discharged to the outside of the connector housing due to the own weight thereof.

[3] A connector engagement structure of the connector according to [1] or [2] and the connection mating connector which connects male terminals (31) in a male terminal side connector housing (40) with the female terminals of the connector by the connector engagement with the connector, wherein the male terminal side connector housing of the connection mating connector includes:

a male terminal holding wall (40*b*) configured to hold the male terminals so as to protrude towards a direction of connector engagement; and a partition wall (41) erected on the male terminal holding wall and partitioning the adjacent male terminals, and wherein, in a state of connector engagement with the connector, the partition wall is formed to be fitted between the protruding enclosure walls of the adjacent female terminal accommodating chambers and to be fitted to the base ends of the protruding enclosure walls.

[4] The connector engagement structure according to [3], wherein the male terminal side connector housing has:

a hood-shaped wall (40*c*) erected on the male terminal holding wall in a hood shape and forming a fitting opening (40*a*) for fitting the connector housing at an end portion thereof; and a pair of guide ribs (43) respectively extending from the fitting opening along the direction of connector engagement inwardly on opposite inner wall surfaces of the hood-shaped wall, wherein extending ends of the pair of guide ribs are coupled to both ends of the partition wall formed so as to extend to both ends of the male terminal holding wall, and wherein the connector housing is formed with a pair of guide grooves (26) extending, on outer wall surfaces opposed to the opposite inner wall surfaces respectively, along the direction of connector engagement so as to engage with the pair of guide ribs.

[5] The connector engagement structure according to [3] or [4], wherein, in a state of connector engagement of the connector and the connection mating connector, the outer wall surface of the connector housing has a protruding part (pressing operation portion 25) located at the vicinity of an end face of the male terminal side connector housing at a fitting opening side, and wherein at least one of the protruding part and a part of the male terminal side connector housing around the protruding part is formed with a leading surface (25*c*) which leads the material (fuel F) causing a leakage current in a direction in which the material is discharged due to the own weight thereof.

In the connector according to [1], since each of the protruding enclosure walls is formed to enclose the outer periphery of each female terminal, a protruding wall surface of each of the protruding enclosure walls are configured such that a creepage distance between the adjacent female terminals is longer. Moreover, the inter-terminal through hole is formed in the wall coupling the female terminal accommodating chambers, so that an area of the wall coupling the adjacent female terminal accommodating chambers is reduced and the material causing a leakage current is discharged to the outside of the connector housing through the inter-terminal through hole. Furthermore, since the material causing a leakage current invaded into the female terminals hardly remains, the occurrence of a leakage current can be reliably prevented even when the material causing a leakage current invaded between the terminals.

In the connector according to [2], since the inter-terminal through hole is formed along the direction in which the material causing a leakage current invaded into the hole is discharged to the outside of the connector housing due to the own weight, the material causing a leakage current invaded between the female terminals can be easily discharged to the outside of the connector housing due to the own weight thereof.

In the connector engagement structure according to [3], an opening is formed, on the connector housing at a side where the female terminals of the adjacent female terminal accommodating chambers are connected with the male terminals, by each of the protruding enclosure walls enclosing the outer periphery of each female terminal. Since the partition wall for partitioning the adjacent male terminals is provided in the male terminal side connector housing so as to be fitted between the protruding enclosure walls of the adjacent female terminal accommodating chambers and to be fitted to the base ends of the protruding enclosure walls, the protruding wall surfaces of the protruding enclosure walls and a wall surface of the partition wall are configured such that a creepage distance between the adjacent male and female terminals is longer. Moreover, the inter-terminal through hole is formed in the wall coupling the female terminal accommodating chambers, so that the area of the wall coupling the adjacent female terminal accommodating chambers is reduced and the material causing a leakage current is discharged to the outside of the connector housing through the inter-terminal through hole. Furthermore, since the material causing a leakage current invaded between the male and female terminals hardly remains, the occurrence of a leakage current can be reliably prevented even when the material causing a leakage current invaded between the terminals.

In the connector engagement structure according to [4], the connector housing and the male terminal side connector housing can be engaged in a regular posture by a guide function due to the engagement of the pair of guide grooves and the pair of guide ribs, and since the pair of guide ribs and the partition wall are continuously provided from one end side to the other end side of the cross-sectional outline of the male terminal side connector housing, the strength of the entire male terminal side connector housing including the hood-shaped wall can be increased.

In the connector engagement structure according to [5], in a state of connector engagement of the connector and the connection mating connector, when there is a protruding part on the outer wall surface of the connector housing at the vicinity of the end face of the male terminal side connector housing at the fitting opening side, since at least one of the protruding part and a part of the male terminal side connector housing around the protruding part is formed with the leading surface which leads the material causing a leakage current in the direction in which the material is discharged due to the own weight thereof, the material causing a leakage current can be prevented from remaining attached to the protruding part.

Although the present invention has been described in detail with reference to the specific embodiments, it is apparent to those skilled in the art that various changes and modifications can be made without departing from the spirit and scope of the present invention.

According to the present invention, it is possible to provide a connector and a connector engagement structure capable of reliably preventing the occurrence of a leakage current even when a material causing a leakage current invaded inter-terminals. The present invention which has this effect is useful for a connector which accommodates female terminals in a plurality of female terminal accommodating chambers arranged side by side in a connector housing, and a connector engagement structure of the connector and a connection mating connector.

What is claimed is:

1. A connector which accommodates female terminals in a plurality of female terminal accommodating chambers arranged side by side in a connector housing, wherein the connector housing has:

a protruding enclosure wall provided at each of the female terminal accommodating chambers in such a way that walls enclosing an outer periphery of each female terminal protrude towards a direction of connector engagement with a mating connector; and a coupling wall configured to couple base ends of the protruding enclosure walls of at least one group of the female terminal accommodating chambers adjacent to each other, and wherein an inter-terminal through hole which penetrates through the inside of the connector housing and is communicated to an outside of the connector housing is formed in the coupling wall, wherein the male terminal side connector housing of the mating connector includes:

a male terminal holding wall configured to hold the male terminals so as to protrude towards a direction of connector engagement; and a partition wall erected on the male terminal holding wall and partitioning the adjacent male terminals, and wherein, in a state of connector engagement with the connector, the partition wall is fitted between the protruding enclosure walls of the adjacent female terminal accommodating chambers and to be fitted to the base ends of the protruding enclosure walls.

2. The connector engagement structure according to claim 1, wherein the male terminal side connector housing has:

a hood-shaped wall erected on the male terminal holding wall in a hood shape and forming a fitting opening for fitting the connector housing at an end portion thereof; and a pair of guide ribs respectively extending from the fitting opening along the direction of connector engagement inwardly on opposite inner wall surfaces of the hood-shaped wall, wherein extending ends of the pair of guide ribs are coupled to both ends of the partition wall formed so as to extend to both ends of the male terminal holding wall, and wherein the connector housing is formed with a pair of guide grooves extending, on outer wall surfaces opposed to the opposite inner wall surfaces respectively, along the direction of connector engagement so as to engage with the pair of guide ribs.

3. The connector engagement structure according to claim 1, wherein, in a state of connector engagement of the connector and the mating connector, the outer wall surface of the connector housing has a protruding part located at the vicinity of an end face of the male terminal side connector housing at a fitting opening side, and wherein at least one of the protruding part and a part of the male terminal side connector housing around the protruding part is formed with a leading surface which leads the material causing a leakage current in a direction in which the material is discharged due to its own weight thereof.

4. The connector according to claim 1, wherein the inter-terminal through hole is formed along a direction in which a material causing a leakage current invaded into the hole is discharged to the outside of the connector housing due to its own weight thereof.

* * * * *